US007520526B2

(12) United States Patent
Muscatelli

(10) Patent No.: US 7,520,526 B2
(45) Date of Patent: Apr. 21, 2009

(54) BINDING WITH ADJUSTABLE HEEL-CUP FRAME

(75) Inventor: Arnaud Muscatelli, Divonne les Bains (FR)

(73) Assignees: E.I. Du Pont de Nemours; NID Ecker S.A.

( * ) Notice: Subject to any disclaimer, the term of this patent is extended or adjusted under 35 U.S.C. 154(b) by 306 days.

(21) Appl. No.: 11/606,595

(22) Filed: Nov. 30, 2006

(65) Prior Publication Data

US 2007/0187927 A1 Aug. 16, 2007

Related U.S. Application Data

(60) Provisional application No. 60/740,753, filed on Nov. 30, 2005.

(51) Int. Cl.
*A63C 9/00* (2006.01)

(52) U.S. Cl. ..... 280/617; 280/14.22

(58) Field of Classification Search ..... 280/617, 280/618, 619, 616, 613, 607, 623, 624, 628, 280/626, 14.21, 14.22, 14.24, 11.36, 633
See application file for complete search history.

(56) References Cited

U.S. PATENT DOCUMENTS

| | | | | |
|---|---|---|---|---|
| 5,172,924 | A * | 12/1992 | Barci | 280/14.22 |
| 5,190,311 | A | 3/1993 | Carpenter et al. | |
| 5,277,635 | A * | 1/1994 | Gillis | 441/74 |
| 5,806,876 | A * | 9/1998 | Alden | 280/627 |
| 5,975,557 | A | 11/1999 | Snoke et al. | |
| 7,073,809 | B2 * | 7/2006 | Holzer | 280/607 |
| 7,159,892 | B2 * | 1/2007 | Draper et al. | 280/617 |
| 7,232,132 | B2 * | 6/2007 | Elkington | 280/11.32 |
| 7,246,811 | B2 * | 7/2007 | Martin | 280/611 |
| 7,367,579 | B2 * | 5/2008 | Elkington | 280/611 |
| 2004/0113392 | A1 | 6/2004 | Elkington | |
| 2004/0169350 | A1 | 9/2004 | Elkington | |

FOREIGN PATENT DOCUMENTS

| | | | |
|---|---|---|---|
| EP | 0 836 869 | A2 | 4/1998 |
| EP | 0 855 200 | A1 | 7/1998 |
| EP | 1 149 611 | A1 | 10/2001 |
| EP | 1 186 328 | A2 | 3/2002 |
| EP | 1 447 117 | A1 | 8/2004 |
| WO | WO 97/31687 | | 9/1997 |
| WO | WO 2005/049156 | A2 | 6/2005 |

OTHER PUBLICATIONS

PCT International Search Report and Written Opinion for International Application No. PCT/US2006/046006 dated Apr. 5, 2007.

* cited by examiner

*Primary Examiner*—Christopher P Ellis
*Assistant Examiner*—Bridget Avery

(57) ABSTRACT

A binding, in particular a snowboard binding, comprises a base plate, a heel-cradling element and means for fastening the heel-cradling element to the base plate in a manner allowing longitudinal adjustment of its position The heel-cradling element comprises a heel-cup frame of generally U-shape in plan view, having spaced arms connected by a curved heel-cradling part, the arms fitting over opposite sides of the base plate. The arms have a profile in the form of a downwardly-open longitudinal channel, and the base plate has spaced longitudinal guide rails on which the longitudinal channels slidably engage. The fastening means include a single screw on each side, accessible from above the top of the arms.

13 Claims, 5 Drawing Sheets

BINDING WITH ADJUSTABLE HEEL-CUP FRAME

This application claims the benefit of U.S. Provisional Application No. 60/740,753, filed Nov. 30, 2005.

CROSS REFERENCE

This application cross references U.S. Application No. 60/740,806 entitled "Improved Board Binding" concurrently filed Nov. 30, 2005 by inventor Arnaud Muscatelli, the contents whereof are incorporated herein by way of reference.

FIELD OF THE INVENTION

The present invention relates to a binding for holding a foot on a flat surface. Generally the binding can be used for holding a foot on a flat surface of a board having an opposite side that is adapted to allow the board to be used to slide or glide relative to a support interface be it snow, water or the air, or to roll over a solid support surface when the board is fitted with rollers. More particularly, the present invention relates to a binding of the type comprising a base plate, a heel-cradling element and means for fastening the heel-cradling element to the base plate in a manner allowing longitudinal adjustment of the position of the heel-cradling element.

BACKGROUND OF THE INVENTION

Snowboarding has become increasingly popular in the last decade. The binding that holds the rider's feet onto the board plays an important role in ensuring safety, comfort and maneuverability.

The most popular conventional soft bindings for snowboarding use a two-strap system in which the boot of the rider is placed on a plate that is fastened to the snowboard, and held in place by a first strap that is fastened over the toes and a second strap that is fastened over the instep. This type of system suffers the drawback that the heel-cradling element either is not longitudinally adjustable or, if it is, it is not easy to adjust.

Attempts have been made to make snowboard bindings have "step-in" characteristics that are common in downhill ski bindings. For example, a common "step-in" system uses a base plate having a clipping mechanism, which can lock on a corresponding mechanism fixed on the sole of the boot. This type of "step-in" suffers the drawback that a particular binding can only be used with a corresponding boot since the mechanism on the binding must mate with the mechanism on the boot. In addition, because the attachment to the board is over a smaller area, and the outsole of the boot includes part of the coupling mechanism and no strap supports pass over the boot, the boot must be made rigid over some portions, to provide support to the foot and ankle. This renders the boot less comfortable. Rigid boots are also less popular because the snowboard piloting is less precise.

Another type of "step-in" system has been proposed, that attempts to combine the convenience of step-in systems with the control levels attainable with two-straps, called the "BACK-IN" system. An example is the Flow/K2 binding system that has similarities to a two-strap binding, except that the boot enters the binding through the back (which then clips into place) rather than the top. The rider's boot is held down by a single webbing that covers most of the boot and is held on by straps. The BACK-IN binding suffers the drawback that the rigidity is increased because of the rigidity of the high back, and the overall feeling and pressure repartition over the boot is rougher compared to a conventional soft two-strap binding.

The above-mentioned two-strap type of binding for receiving soft boots is thus preferred, but their arrangements for allowing longitudinal adjustment of the position of the cradling element on the base plate are unsatisfactory. Due to design considerations, fixing screws are conventionally situated in a horizontal plane and are accessible laterally. It is frequently necessary to remove the screws from their counter-support, but this manipulation is non-ergonomic and leads frequently to the loss of the screw elements. Moreover, with the conventional adjustment system, the fixing screws transmit forces mainly by shearing and this leads to a loss of the precision of adjustment especially for all-polymer binding structures where the distance between two fixed positions (e.g. the distance between two holes) depends principally on resistance criteria. The conventional system thus, does not allow a fine adjustment according to the different boot sizes and the different boot-size norms. Nor do the existing systems achieve a fully satisfactory envelope corresponding to anatomic requirements for fitting different feet/boots.

The following disclosures may be relevant to various aspects of the present invention and may be briefly summarized as follows:

U.S. Patent Application Number 2004/0169350 describes a rear-entry snowboard binding in which the base plate has projecting side plates supporting two independent elements on which a separate heel is pivoted, allowing rear entry to the binding. This specifically rear-entry binding allows longitudinal adjustment by cooperating serrations, but is complicated due to the multiple parts and their connections, and the rear part of the structure is not designed to support tensions of the magnitude and direction produced by the instep-strapping arrangement of a two-strap binding. Hence, its teaching is not applicable to bindings of the two-strap type.

It is desirable for an embodiment of the present invention to allow longitudinal adjustment of the position of the cradling element on the base plate. It is further desirable that an embodiment of the present invention provide a binding that is simple and convenient to adjust and of simple and robust construction.

SUMMARY OF THE INVENTION

Briefly stated, and in accordance with one aspect of the present invention, there is provided a binding for holding a foot on a flat surface, comprising a base plate, a heel-cradling element and means for fastening the heel-cradling element to the base plate in a manner allowing longitudinal adjustment of the position of the heel-cradling element, wherein:

- the heel-cradling element comprises a heel-cup frame having a U-shape in a plan view, the heel-cup frame having spaced arms connected by a curved heel-cradling part, the arms fitting over opposite sides of the base plate;
- the arms of the heel-cup frame have a profile in the form of a downwardly-open longitudinal channel;
- the base plate has spaced longitudinal guide rails on which the longitudinal channels of the arms slidably engage; and said fastening means holding the arms on the guide rails in any selected position, said fastening means being accessible from above the top of the arms.

BRIEF DESCRIPTION OF THE DRAWINGS

The invention will be more fully understood from the following detailed description, taken in connection with the accompanying drawings, in which.

Figure 1A:
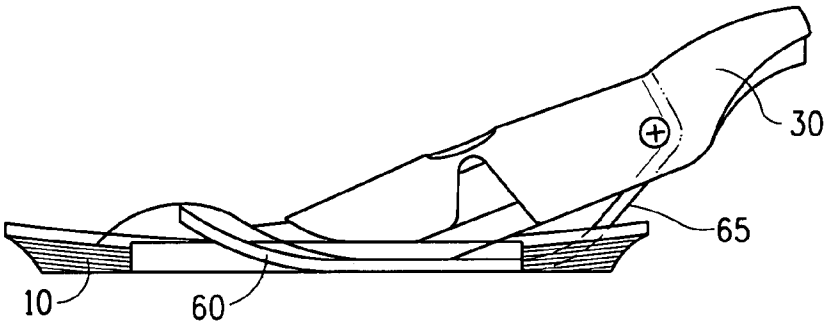
FIG. 1A is a partial view corresponding to FIG. 1, showing a detail of a variation.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

In the present invention, there is provided a binding for use on boards where the foot needs to remain on the surface of the board including snowboards and wakeboards where the rider may be barefooted.

References in the specification and the accompanying claims to "foot" include instances where the foot is bare and also where the foot is covered by footwear, in particular, a boot in the case of a snowboard binding.

In a preferred embodiment of the present invention, the tops of the guide rails are inclined at an angle up to 30° to the plane of the base plate so that the arms of the heel-cup frame are held inclined at an angle up to 30° to the plane of the base plate. This angle, combined with the longitudinal length adjustment, provides an automatic height adjustment in proportion to the size of the rider's boots.

Preferably, the rails and arms diverge slightly towards the front of the binding to provide the best anatomic fit for a boot.

To improve guiding, the downwardly-open longitudinal channels of the arms can have an inverted-U profile, the sides of this profiles fitting closely against sides of the rails. Other mating profiles are possible.

The fastening means can comprise, for each arm and rail, a screw passing through an opening in the top of the arm and through a longitudinal slot in the rail, the screw engaging with a nut below the rail. Advantageously, a top end of the screw is supported on the top of the arm by an elongate washer that preferably extends further towards the rear part of the arm than towards the front part. This washer has for effect to distribute the screw's hold-down effect over a long part of the top of the arm, and to provide a strong moment about the lower support points. As a result, it is possible with a single screw to assure a very strong support. The thus-fixed heel-cup frame can be subjected to large forces without risk of breakage.

The tops of the rails and the inside top part of the downwardly-open longitudinal channel of the arms can have cooperating serrations for holding the heel-cup frame in position. By choosing the width of the serrations, it is possible to set the incremental longitudinal adjustment to fit all boot sizes according to the different norms.

The arms of the heel-cup frame preferably have apertures for receiving the ends of an instep-strapping arrangement. These apertures are located between the curved heel-cradling part and the fastening means. The arms and the sides of the base plate can also have openings defining a path for receiving a flexible linkage such as a cable. A forward part of the base plate can have, in its opposite sides, apertures for receiving the ends of a toe-cradling element. The binding may further comprise one or more of the following elements: an instep-strapping arrangement connected to the arms of the heel-cup frame; a toe-cradling element connected to a forward part of the base plate; and a flexible linkage connecting the instep-strapping arrangement and the toe-cradling element.

Figure 4:
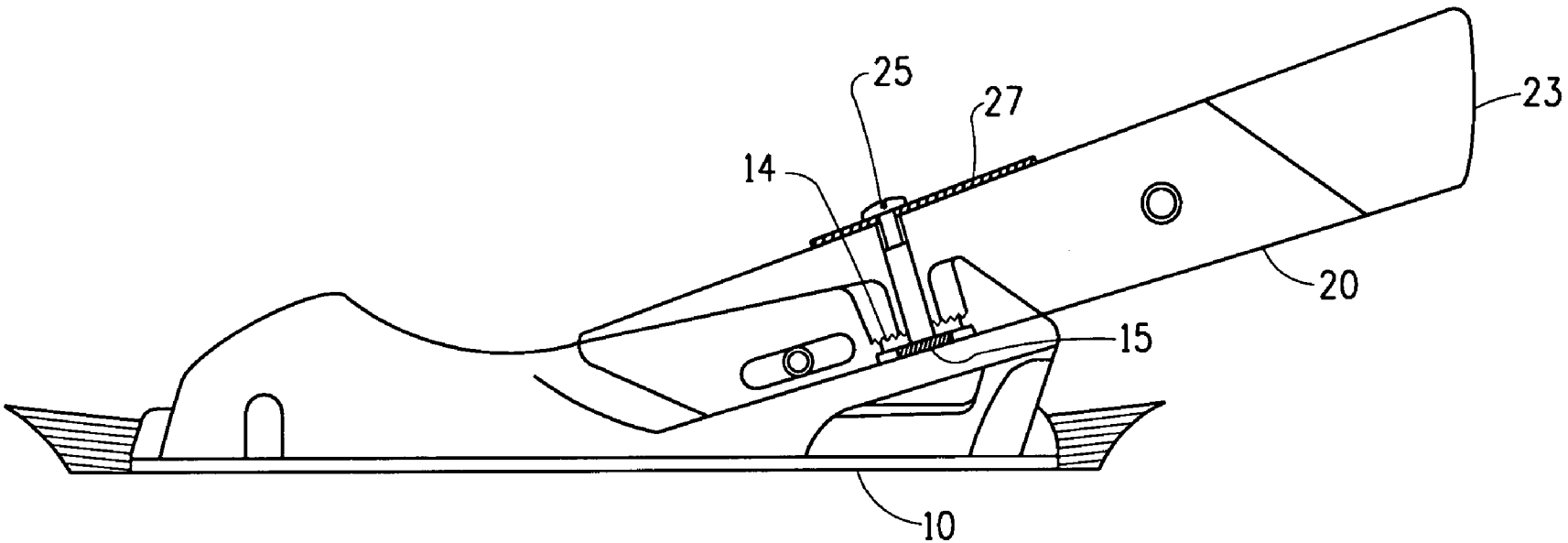
FIG. 4 is a schematic side-elevation of an embodiment of a base plate and heel-cup frame of a snowboard binding according to the invention.
Figure 5:
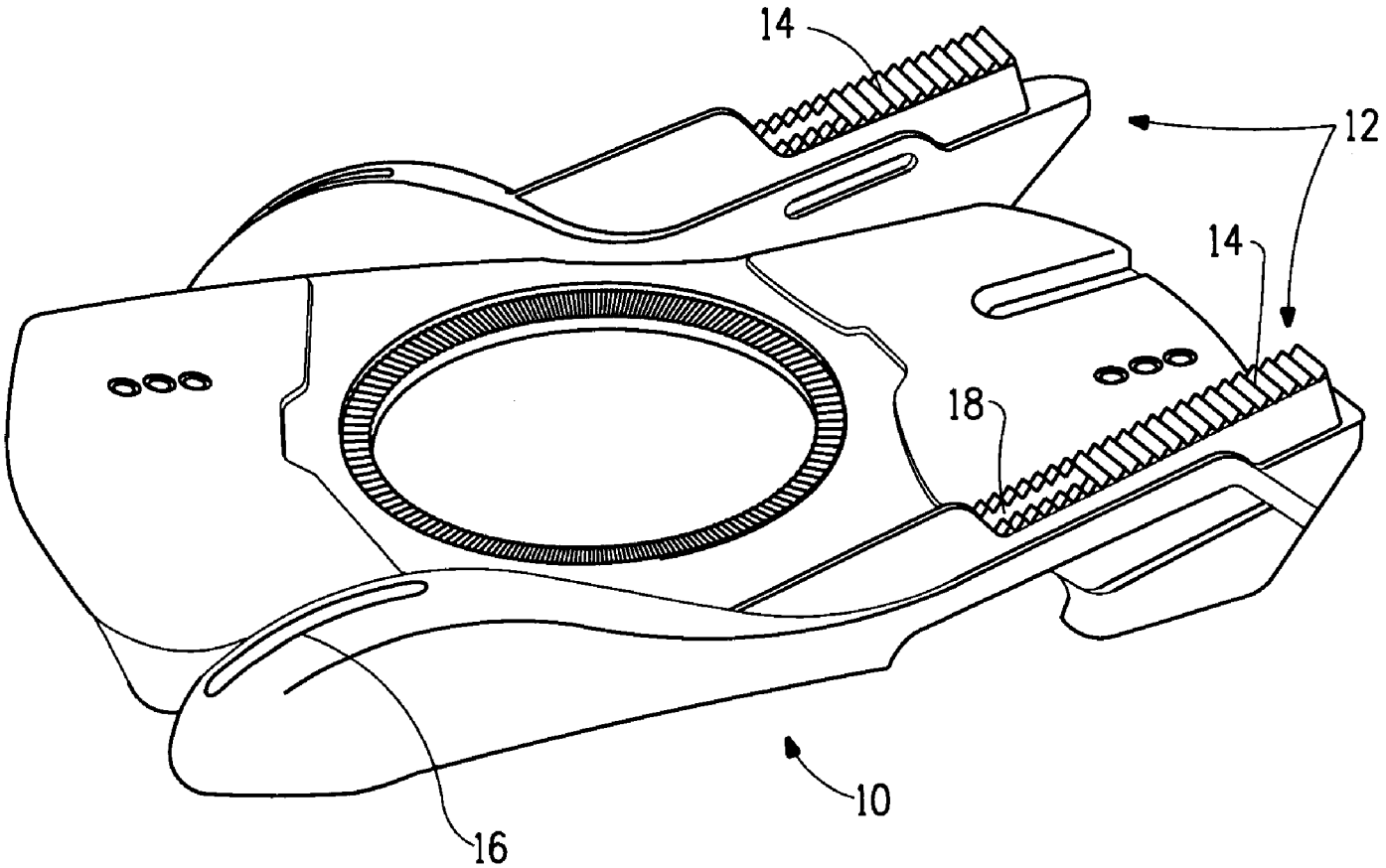
FIG. 5 is a perspective view of the base plate.
Figure 6:
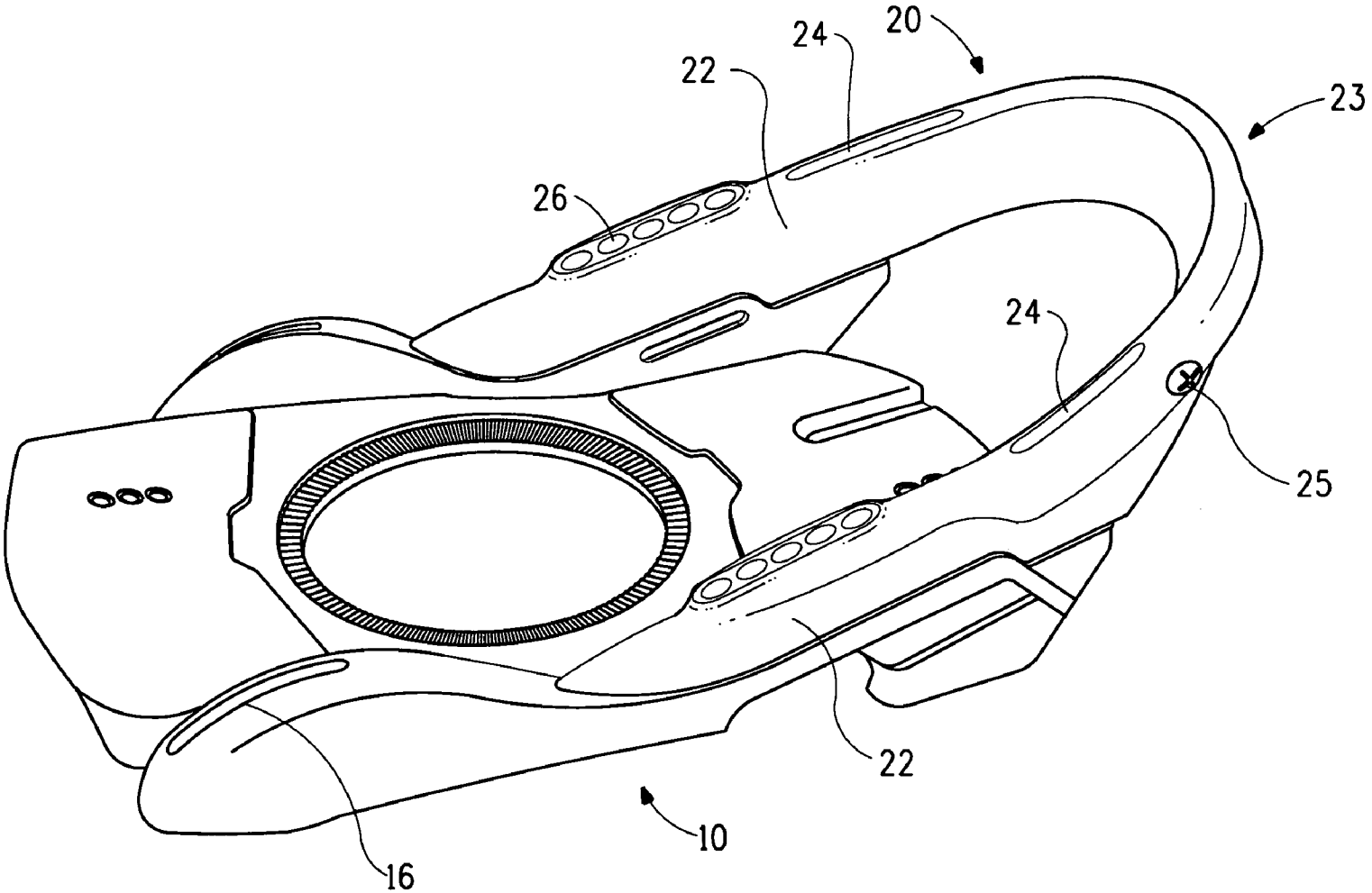
FIG. 6 is a perspective view of a heel-cup frame placed on the base plate.

Reference is now made to the drawings for a detailed description of the present invention. FIGS. 1, 1A, 2 and 3 show the binding with its fittings, ready for use. FIGS. 4 to 6 show in detail the base plate 10 and heel-cup frame 20.

Figure 1:
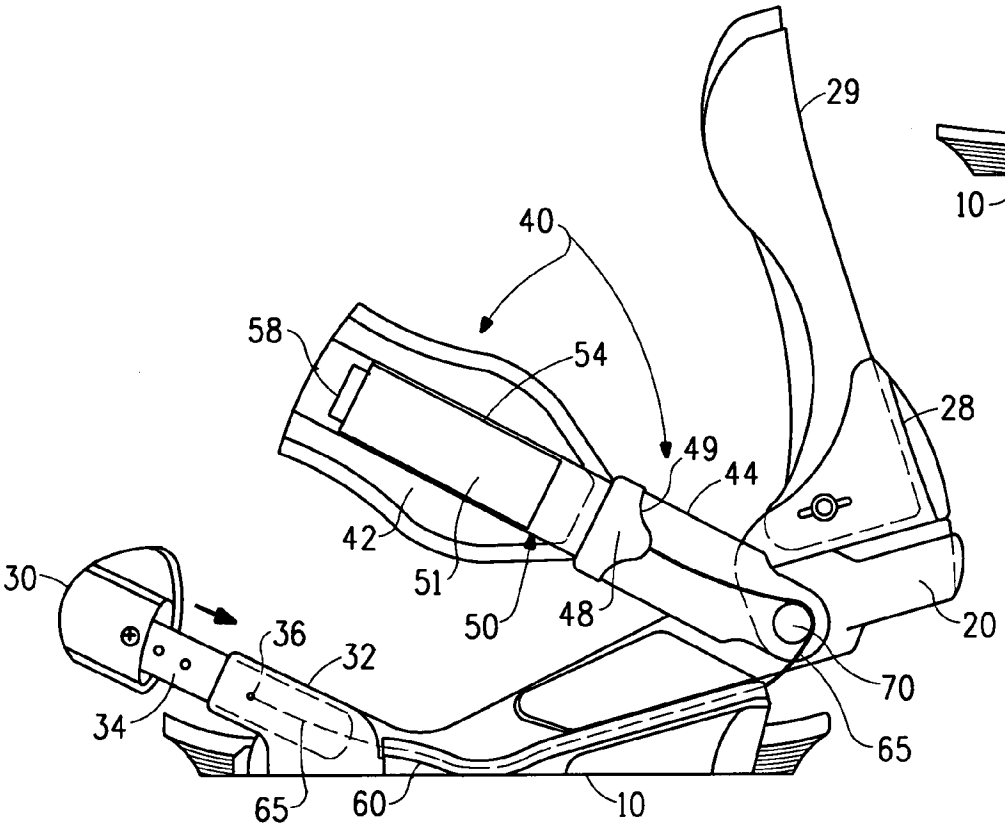
FIG. 1 is a schematic side-elevation of an embodiment of a snowboard binding according to the invention.
Figure 2:
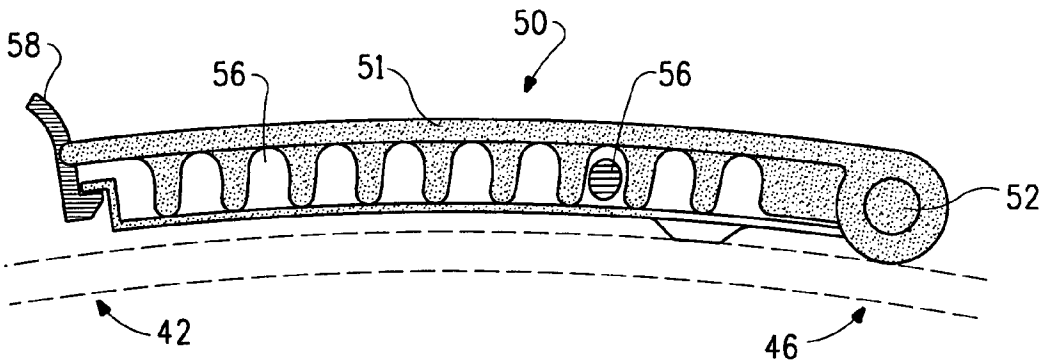
FIG. 2 is a schematic cross-section though a lever of an instep-strapping arrangement's closure member.

Reference is now made to FIG. 1. An embodiment of the invention has a binding comprising a base plate 10, a heel-cup frame 20 and means for fastening the heel-cup frame 20 to the base plate 10 in a manner allowing longitudinal adjustment of the position of the heel-cup frame 20.

Referring now to FIGS. 4 and 6, the heel-cup frame 20 is an integral molded piece of plastics material that is generally of U-shape in plan view, and has spaced (parallel or slightly diverging) arms 22 connected by a curved heel-cradling part 23. The arms 22 fit over opposite sides of the base plate 10. On its rear curved heel-cradling part 23, the heel-cup frame 20 supports any conventional heel-supporting assembly including for example an adjustable heel-piece 28 (FIG. 1) and a highback 29 (FIG. 1).

With continued reference to FIG. 6, the arms 22 of the heel-cup frame 20 have a hollow profile in the form of a downwardly-open longitudinal channel of inverted-U shape. The base plate 10 has spaced longitudinal guide rails 12 (FIG. 5) on which the longitudinal channels of the arms 22 slidably engage with a close fit, the sides of the inverted-U profiles fitting closely against sides of the rails 12 (FIG. 5) with just enough play to allow sliding. Other mating profiles are possible.

The fastening means are screws 25 that hold the arms 22 on the guide rails 12 (FIG. 5) in any selected position. These fastening screws 25 are fitted in the arms/rails 22/12 and are accessible from above the top of the arms 22.

In the illustrated embodiment shown in FIG. 5, the tops of the guide rails 12 are inclined at an angle up to 30° to the plane of the base plate 10 so that the arms 22 (FIG. 6) of the heel-cup frame 20 (FIG. 6) are held inclined at an angle up to 30° to the plane of the base plate 10. This angle, combined with the longitudinal length adjustment of the arms 22 (FIG. 6) and rails 12, provides a convenient automatic height adjustment in proportion to the size of the rider's boots.

The rails 12 (FIG. 5) and arms 22 (FIG. 6) can diverge slightly towards the front of the binding which means that they converge towards the rear to provide the best anatomic fit for the boot heel. This slight divergence/convergence is still possible without interfering with the sliding of the arms, which is possible due to the elasticity and the low friction of the plastic materials used.

Reference is again made to FIG. 6. The fastening means comprise, for each arm 22 and rail 12 (FIG. 5), a single screw 25 passing through an opening 26 in the top of the arm 22 and through a longitudinal slot 18 (FIG. 5) in the rail 12. The screw 25 engages with a T-nut 15 (FIG. 4) below the rail 12. A shock-absorber material can be positioned along and around the screw's axis.

The top end of screw 25 is supported on the top of the arm 22 by an elongate washer 27 (FIG. 4), that extends at least about twice further towards the rear part of the arm 22 than towards the front part. This washer 27 distributes the screw's hold-down effect over a long part of the top of the arm 22, and provides a strong moment about the lower support points. As a result, it is possible with a single screw 25 to assure a very strong support. Thus, the fixed heel-cup frame 20 can be subjected to large forces without risk of failure.

The tops of the rails 12 and the inside top part of the downwardly-open longitudinal channel of the arms 22 have cooperating serrations 14 (shown in FIG. 5 for the rails 12) for holding the heel-cup frame 20 in position. The width of the serrations 14 is chosen to set the incremental longitudinal adjustment to fit all boot sizes according to the different norms. In addition, to facilitating length adjustment, the serrations 14 contribute to the excellent locking effect achieved by the screws 25.

Figure 3:
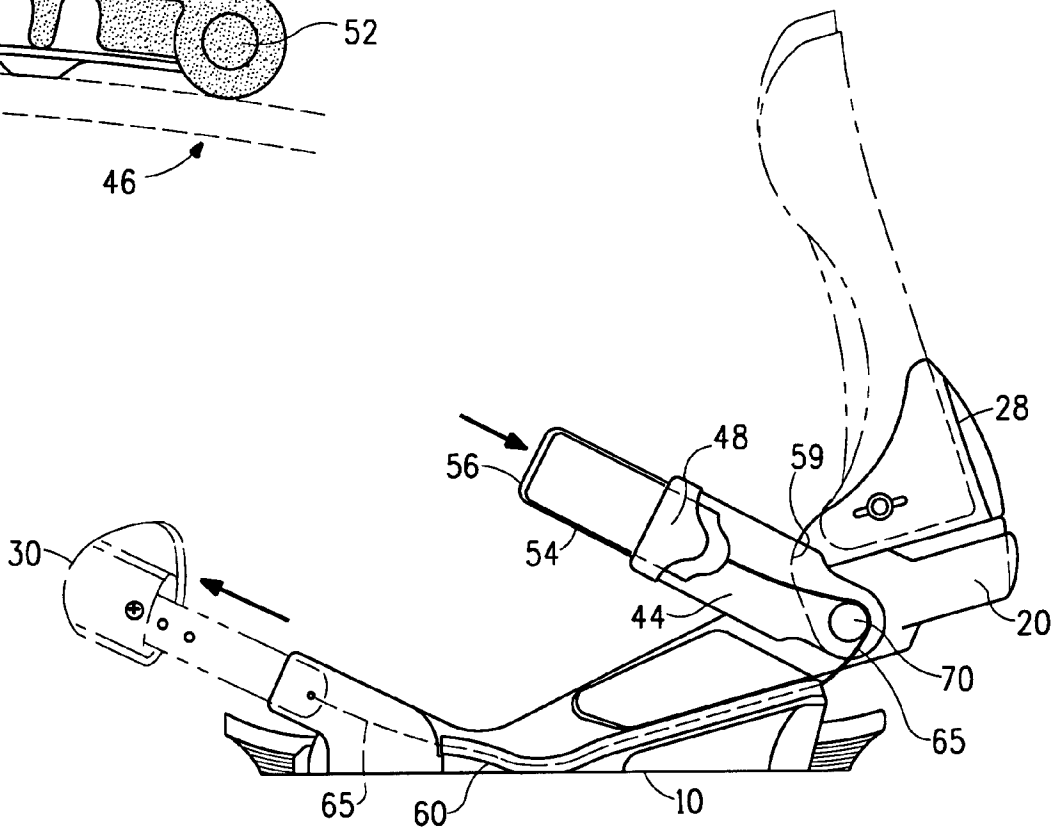
FIG. 3 is a view corresponding to FIG. 1 showing the binding in the open state, leaving off the main body of the instep-strapping arrangement.

With continuing reference to FIG. 6, the arms 22 of the heel-cup frame 20 have apertures 24 for receiving the end parts of an instep-strapping arrangement 42/44, as shown in FIGS. 1 and 3. These apertures 24 are located between the curved heel-cradling part 23 and the fastening means (screws 25 with their openings 26).

The arms 22 and the sides of the base plate 10, also have openings defining a path for receiving a flexible linkage 65 such as a cable (FIGS. 1 and 1A). Conveniently, the base plate 10 and its fittings will have recesses for accommodating a flexible linkage on either side, even though a linkage is needed only on one side. In this way the bindings can be made "universal" for the rider's front or rear foot.

A forward part of the base plate 10 has in its opposite sides, apertures 16 (FIGS. 5 and 6) for receiving the end parts 32 (FIG. 1) of a toe-cradling element 20 (FIG. 1).

Referring again to FIG. 1, the binding may further comprise one or more of the following elements: an instep-strapping arrangement 40 connected to the arms 22 (FIG. 6) of the heel-cup frame 20; a toe-cradling element 30 connected to a forward part of the base plate 10; and a flexible linkage 65 connecting the instep-strapping arrangement 40 and the toe-cradling element 30. Flexible linkage 65 passes through transmission element 60 and around pulley 70 and is attached to closure 54 and 56 (FIG. 3).

Further details of the complete binding are given in the companion patent application entitled "Improved Board Binding".

In view of the disclosure above of the present invention, the heel-cup frame is firmly fixed on the base plate, with possibility for fine adjustment of the longitudinal position. The profiled arms fitting on the guide rails provide a strong assembly. Accessibility of the fastening means from the top of the arms results in ease of manipulation, and the fastening means can be retained in the arms/rails thus avoiding loss. Because of the binding's architecture it is possible to use a single fastening means on each side—such as one screw on each side fitted with a T-nut in the rail—which simplifies manipulation, without leading to a reduction of strength.

Furthermore, the heel-cup frame, firmly secured according to the invention, is designed to be used as anchorage for the opposite sides of the instep-strapping arrangement of a two-strap type of binding, which was not possible with the rear-entry binding of US patent application 2004/0169350.

Moreover, the present invention design lends itself to the introduction of shock absorbing members in the arm and rail assembly.

It is therefore, apparent that there has been provided in accordance with the present invention, a binding with adjustable heel-cup frame that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. A binding for holding a foot on a flat surface of a board having an opposite side that is adapted to allow the board to be used to slide, roll or glide, the binding comprising a base plate, a heel-cradling element and means for fastening the heel-cradling element to the base plate in a manner allowing longitudinal adjustment of the position of the heel-cradling element, wherein:

the heel-cradling element comprises a heel-cup frame having a U-shape in a plan view, the heel-cup frame having spaced arms connected by a curved heel-cradling part, the arms fitting over opposite sides of the base plate;

the arms of the heel-cup frame have a profile in the form of a downwardly-open longitudinal channel;

the base plate has spaced longitudinal guide rails on which the longitudinal channels of the arms slidably engage; and said fastening means holding the arms on the guide rails in any selected position, said fastening means being accessible from above the top of the arms.

2. The binding of claim 1, wherein the tops of the guide rails are inclined at an angle up to 30° to the plane of the base plate so that the arms of the heel-cup frame are held inclined at an angle up to 30° to the plane of the base plate.

3. The binding of claim 1, wherein said rails and said arms converge slightly towards the rear of the binding.

4. The binding of claim 1, wherein the downwardly-open longitudinal channels of the arms have an inverted-U profile, the sides of this profile fitting closely against sides of the rails.

5. The binding of claim 1, wherein said fastening means comprise for each arm and rail a screw passing through an opening in the top of the arm and through a longitudinal slot in the rail, the screw engaging with a nut below the rail.

6. The binding of claim 1, wherein the tops of the rails and the inside top part of the downwardly-open longitudinal channel of the arms have cooperating serrations for holding the heel-cup frame in position.

7. The binding of claim 1, wherein the arms of the heel-cup frame have, between the curved heel-cradling part and the fastening means, apertures for receiving the ends of an instep-strapping arrangement.

8. The binding of claim 1, wherein the arms of the heel-cup frame and the sides of the base plate have openings defining a path for receiving a flexible linkage such as a cable.

9. The binding claim 1, wherein a forward part of the base plate has, in its opposite sides, apertures for receiving the ends of a toe-cradling element.

10. The binding of claim 1, further comprising an instep-strapping arrangement connected to the arms of the heel-cup frame.

11. The binding of claim 1, further comprising a toe-cradling element connected to a forward part of the base plate.

12. The binding of claim 5, wherein a top end of said screw is supported on the top of the arm by an elongate washer, that preferably extends further towards the rear part of the arm than towards the front part.

13. The binding of claim 10, further comprising a flexible linkage connecting the instep-strapping arrangement and a toe-cradling element.

* * * * *

UNITED STATES PATENT AND TRADEMARK OFFICE

CERTIFICATE OF CORRECTION

PATENT NO. : 7,520,526 B2
APPLICATION NO. : 11/606595
DATED : April 21, 2009
INVENTOR(S) : Muscatelli Arnaud It is certified that error appears in the above-identified patent and that said Letters Patent is hereby corrected as shown below:

Please amend claim 9 as shown below:

9. The binding of claim 1, wherein a forward part of the base plate has, in its opposite sides, apertures for receiving the ends of a toe-cradling element.

Signed and Sealed this

Sixteenth Day of June, 2009

JOHN DOLL
*Acting Director of the United States Patent and Trademark Office*

UNITED STATES PATENT AND TRADEMARK OFFICE

CERTIFICATE OF CORRECTION

PATENT NO. : 7,520,526 B2
APPLICATION NO. : 11/606595
DATED : April 21, 2009
INVENTOR(S) : Muscatelli Arnaud It is certified that error appears in the above-identified patent and that said Letters Patent is hereby corrected as shown below:

Column 6, lines 65-67, please amend claim 9 as shown below:

9. The binding of claim 1, wherein a forward part of the base plate has, in its opposite sides, apertures for receiving the ends of a toe-cradling element.

This certificate supersedes the Certificate of Correction issued June 16, 2009.

Signed and Sealed this

Fourteenth Day of July, 2009

John Doll

JOHN DOLL
*Acting Director of the United States Patent and Trademark Office*